US007516959B2

(12) United States Patent
Huard et al.

(10) Patent No.: US 7,516,959 B2
(45) Date of Patent: Apr. 14, 2009

(54) METHOD AND APPARATUS FOR TOURNAMENT BETTING

(75) Inventors: Marcel Huard, St-Romuald (CA); Réal Bérubé, St-Jean-Chrysostome (CA)

(73) Assignee: DEQ Systèmes Corp., Saint-Romuald (Québec) (CA)

( * ) Notice: Subject to any disclaimer, the term of this patent is extended or adjusted under 35 U.S.C. 154(b) by 144 days.

(21) Appl. No.: 11/167,305

(22) Filed: Jun. 28, 2005

(65) Prior Publication Data

US 2006/0246983 A1 Nov. 2, 2006

Related U.S. Application Data

(63) Continuation-in-part of application No. 10/163,623, filed on Jun. 7, 2002, now Pat. No. 6,929,264.

(60) Provisional application No. 60/363,282, filed on Mar. 12, 2002, provisional application No. 60/349,558, filed on Jan. 22, 2002.

(51) Int. Cl.
*A63F 3/00* (2006.01)

(52) U.S. Cl. ..... 273/274; 273/259; 273/277

(58) Field of Classification Search ..... 273/274, 273/259, 277

See application file for complete search history.

(56) References Cited

U.S. PATENT DOCUMENTS

| | | | | |
|---|---|---|---|---|
| 4,861,041 | A | 8/1989 | Jones et al. | |
| 5,042,810 | A | 8/1991 | Williams | |
| 5,393,067 | A | 2/1995 | Paulsen et al. | |
| 5,570,885 | A | 11/1996 | Ornstein | |
| 5,586,766 | A | 12/1996 | Forte et al. | |
| 5,823,875 | A | 10/1998 | Tarantino | |
| 5,823,879 | A * | 10/1998 | Goldberg et al. | 463/42 |
| 5,829,750 | A | 11/1998 | Booker | |
| 5,836,586 | A * | 11/1998 | Marks et al. | 273/292 |
| 5,868,392 | A | 2/1999 | Kraft | |
| 5,871,213 | A | 2/1999 | Chadband et al. | |
| 6,019,374 | A * | 2/2000 | Breeding | 273/292 |
| 6,070,878 | A | 6/2000 | Jones et al. | |

(Continued)

FOREIGN PATENT DOCUMENTS

| | | |
|---|---|---|
| WO | WO 99/10057 | 3/1999 |

*Primary Examiner*—Vishu K. Mendiratta
(74) *Attorney, Agent, or Firm*—Ogilvy Renault; Isabelle Chabot

(57) ABSTRACT

The method of betting on participants in a tournament comprises creating at least two teams of at least one participating player playing in the tournament, the tournament having a series of at least two casino games in which the participating players will play; associating at least one event with at least one participating player during the tournament; a betting player selecting at least one chosen participant on which to place a bet, each of the chosen participant being one of a team and a participating player; the betting player identifying at least one event related to the tournament for which to place the bet, wherein the event is meaningful within the tournament; the betting player making a that the event will occur in association with the chosen participant during the tournament; determining an occurrence of the event in association with the chosen participant; and if the event occurred in association with the participant, determining a payout to be paid to the betting player; wherein the betting player is one of the participating player and a player who does not participate in the tournament. An apparatus is also provided.

6 Claims, 2 Drawing Sheets

U.S. PATENT DOCUMENTS

| | | | | |
|---|---|---|---|---|
| 6,113,102 | A | 9/2000 | Marks et al. | |
| 6,146,270 | A | 11/2000 | Huard et al. | |
| 6,237,916 | B1 | 5/2001 | Webb | |
| 6,328,306 | B1 | 12/2001 | Webb | |
| 6,471,210 | B1 | 10/2002 | Goldman et al. | |
| 6,688,978 | B1 * | 2/2004 | Herman | 463/25 |
| 2001/0024015 | A1 | 9/2001 | Hogan et al. | |

* cited by examiner

METHOD AND APPARATUS FOR TOURNAMENT BETTING

CROSS-REFERENCE TO RELATED APPLOCATIONS

This application is a continuation-in-part of allowed U.S. patent application Ser. No. 10/163,623 filed on Jun. 7, 2002, now issued as U.S. Pat. No. 6,929,264, the specification of which is hereby incorporated by reference.

FIELD OF THE INVENTION

The present invention relates to a method and apparatus for betting in a tournament. More particularly, the invention relates to a method and apparatus for allowing a player to make a bet that at least one participant in a casino game tournament will receive a determined event during the tournament.

BACKGROUND OF THE INVENTION

Casino owners are always interested in enhancing the profitability of their casino games. More particularly, new and improved casino games allowing for faster-paced games, an increase in the betting amount per game, and a raise in the player's interest in the game, present a real appeal to casino managers.

Tournaments are very popular and attract many spectators a s players to Casinos. They are a good marketing tool for the owners The multi-table Poker tournament represents probably the most popular and definitely most televised style of poker play. The World Series of Poker and the World Poker Tour, among many others come immediately to mind. The structure of these tournaments is quite simple. For a "buy in," or set amount, players are entered into the tournament. Every player is then given the same number of chips and seated at as many tables as are necessary, and the elimination begins. When a player "busts out," he leaves his seat, and remaining players are moved around to ensure equal numbers at each table. This takes hours and even days to complete in large multi-table tournaments. Only the top few finishers will earn money. Often, the tourney pays the top 10 finishers. For many players who have had great success in regular ring games, the multi-table tournament is a cruel effigy of failure. This can be directly traced to the fact that most players do not grasp the changes needed from their ring game style to a tournament style.

A typical blackjack tournament consists of several rounds of play, with tables of 6 or so players competing against each other in each round. The format is usually an elimination format, where only 1 or 2 players at each table will advance to the next round of play. Each round consists of a set number of hands. All players begin the round with a equal amount of chips. At the end of the round, the player or players with the highest bankroll will advance. Rounds are usually between 20 and 50 hands each. Each player must play each hand with a bet in the allowed range.

Rather than the dealer always dealing to the first chair (first base) first, a button is placed on the table in front of a player, who serves as first base on this hand. The button then moves consecutively around the table with each passing hand. This gives each player the opportunity to play as first base and third base in turn. More importantly, since players must bet in turn starting at the button, the disadvantage of betting and playing before the other players moves around the table.

Most tournaments consist of 3 to 5 rounds. A typical format might be 2 players out of the 6 at the table advance, 1 of 6 advances, then the finals. This format with 6 players at the final table would allow for 108 entries at 18 first round tables. Often in smaller tournaments, the first round will be split up into several qualifying rounds, so that if one does not advance, he can re-enter for another first round seat (often referred to as "re-buy" entry). Often, the prizes that a player will be eligible for, if he reaches the final round after having re-entered in first round, will be smaller than the prizes for players who qualified directly at the first round.

The prize pool for a tournament is usually, but not always, 100% of the entry fees paid by the players. This means that the casino has no advantage over the players in the tournament. Indeed, the skillful player can have a huge advantage over the other players if those players are less experienced in tournament strategy. Many casinos will guarantee the prize money even if the tournament does not fill up with entries. In these cases, the casino is literally paying the players to play the tournament. From the casino's viewpoint, it is a good marketing play, since they are drawing new players to the tables between the tournament rounds.

The prize money varies widely. Smaller tournaments might have an entry fee of $10, and pay $500 or $1000 for first place. Most tournaments pay at least 6 places. Larger tournaments might have an entry fee of $300-$500, with a correspondingly larger payout.

The Pioneer's $25,000 Blackjack Tournament is based on 125 entrants at $250 per entry. Re-buys are priced at $100. The tournament has three main rounds: 1 rst round (with potential re-buys playing in a second round), semi-finals and finals. The Tournament price breakdown is as follows:

| | |
|---|---|
| 1st Place | $11,000.00 |
| 2nd Place | $ 4,500.00 |
| 3rd Place | $ 1,400.00 |
| 4th Place | $ 900.00 |
| 5th Place | $ 650.00 |
| 6th Place | $ 550.00 |
| 7th–36th Place (in Semi-Finals ea.) | $ 200.00 |

New or inexperienced players are often not confident enough to participate in such tournaments. Experienced players who have only an average performance in the game also prefer not to participate in such tournaments. All prefer to watch the tournament live or on television and guess who will win.

It would be advantageous to use the tournament's marketing and visibility advantage to help the casino owner get a higher return on investment.

SUMMARY OF THE INVENTION

It is an object of the present invention to allow a betting player, who can be an outsider or a player in a tournament, to bet on the occurrence of a particular event in the tournament in association with a participant in the tournament, the participant being a player in the tournament or a team of players in the tournament.

Therefore, if a player playing in the tournament feels unlucky that day or believes that another player has a better chance of winning than himself, he can make the bet that the other player will win a particular round or will be ranked at a particular position in the finals.

Similarly, if an outsider the tournament wishes to bet on his guess of who will advance to a next round or of who will be the top three players of the tournament, in order or not, he can be allowed to place such a bet.

This way, all interested individuals can participate and have a chance to win, and at the same time, become more knowledgeable of the game rules and strategies. Players who feel lucky can participate in the tournament, and furthermore can take advantage of lucky or unlucky periods of other players, including the dealer depending on tournament rules, by making bets that these players will obtain certain event. For example, a player who feels lucky may want to maximize his earnings during this lucky period, he will then bet on his own hand, but he might also enjoy betting on the other players' hands.

The method and apparatus of the present invention can be applied to many tournament styles in which a plurality of standard or new casino games are played.

According to a first broad aspect of the present invention, there is provided a method for betting on participants in a tournament. The method comprises creating at least two teams of at least one participating player playing in the tournament, the tournament having a series of at least two casino games in which the participating players will play; associating at least one event with at least one participating player during the tournament; a betting player selecting at least one chosen participant on which to place a bet, each of the chosen participant being one of a team and a participating player; the betting player identifying at least one event related to the tournament for which to place the bet, wherein the event is meaningful within the tournament; the betting player making a that the event will occur in association with the chosen participant during the tournament; determining an occurrence of the event in association with the chosen participant; and if the event occurred in association with the participant, determining a payout to be paid to the betting player; wherein the betting player is one of the participating player and a player who does not participate in the tournament.

According to another broad aspect of the present invention, there is provided an apparatus for betting on participants in a tournament. The apparatus comprises a player registrar for providing an identification of at least two participating players for the tournament; a team builder for creating at least two teams each having at least one of the participating player, the tournament having a series of at least two casino games in which the participating players will play; a tournament controller for associating at least one event with at least one participating player during the tournament; a player betting station connected to the tournament controller allowing a betting player to select at least one chosen participant on which to place a bet, to identify at least one event related to the tournament for which to place the bet and to make at least one bet that the at least one event will occur in association with the at least one chosen participant during the tournament, wherein each the chosen participant is one of a team and participating player and the event is meaningful within the tournament; a bet controller determining an occurrence of the at least one event in the tournament in association with the at least one chosen participant; and a payout calculator to determine a payout to be paid to the betting player if the at least one event occurred in association with the at least one participant; wherein the betting player is one of the participating player and a player who does not participate in the tournament.

According to a further broad aspect, there is provided a method of betting on participants in a tournament. The method comprises: providing an identification of at least two participating players participating in a tournament including an indication of a tournament team to which each of the participating players belongs, at least two of the tournament teams participating in the tournament, the tournament having a series of casino games in which the participating players will play; carrying out the series of casino games according to rules of play of the casino games, including associating at least one event with at least one participating player during the tournament; a betting player creating a selection team by selecting at least two chosen participants on which to place a bet, each the chosen participant being one of the participating players belonging to one of the tournament teams, the selection team comprising chosen participants from at least two non-identical tournament teams; the betting player identifying at least one event related to the tournament for which to place the bet, wherein the event is meaningful within the tournament; the betting player making at least one bet that the at least one event will occur in association with the selection team during the tournament; determining an occurrence of the at least one event in the tournament in association with the at least one chosen participant of the selection team; and if the at least one event occurred in association with the selection team, determining a payout to be paid to the betting player; wherein the betting player is one of the participating player and a player who does not participate in the tournament.

According to a further broad aspect, there is provided an apparatus for betting on participants in a tournament. The apparatus comprises: a player registrar including a participating player information register for registering an identification of at least two participating players participating in the tournament, the tournament including at least two tournament teams, and a tournament team register for registering an indication of one of the at least two tournament teams to which each of said participating players belong; a tournament controller associating and storing at least one event meaningful within the tournament with at least one of the participating players during a series of casino games carried out within the tournament according to rules of play of the casino games; a player betting station connected to and in communication with the tournament controller and the player registrar, the player betting station including: a selection team input for receiving and registering a selection team by at least one betting player, the selection team including at least two chosen participants selected among the participating player information register and the selection team input communicating with the tournament team register for preventing the at least one betting player to select participating players not belonging to the tournament teams and chosen participants from a single one of the tournament teams; a bet event input receiving and registering at least one bet event related to the tournament and meaningful within the tournament; and a bet input receiving and registering at least one bet by the at least one betting player that the at least one bet event will occur in association with the selection team during the tournament; a bet controller operatively connected and in communication with the tournament controller and the player betting station, the bet controller for determining an occurrence of the at least one bet event in the tournament in association with the at least one chosen participant of the selection team; and a payout calculator, in communication with the player betting station and to the bet controller, for determining a payout to be paid to the betting player if the at least one bet event occurred in association with the selection team; wherein the betting player is one of the participating player and a player who does not participate in the tournament.

For the purpose of the present invention, the term "casino game" is intended to mean any game being played in a casino or being provided for by a casino for play, either physically or online. They can be table games, slot machines, race and sports events. Examples of such games include blackjack, poker, dice, roulette, baccarat, craps, Spanish 21, mini-baccarat, pai-gow and pai-gow poker, slot machines, horse racing, dog racing, etc.

For the purpose of the present invention, the term "tournament" is intended to mean a series of games in which a number of participants compete and the one that prevails through the final round or that finishes with the best record is declared the winner. Participants can be ranked to determine their final ranking or place. Typically, the same casino game will be played by the participants throughout the tournament.

For the purpose of the present invention, the term "participant" in intended to mean any entity which participates in a tournament, namely an individual player member of a team or a team.

For the purpose of the present invention, the term "event" is intended to mean any event which occurs during the course of a casino game. It can be associated to a player or not. It can constitute a preliminary, intermediary or end result of the game. It can comprise a selection or combination of gaming symbols. The mere occurrence of a gaming symbol during a play of a game can be considered to be an event. An event can be a player's hand of cards at the end of a play of a card game. Another example of an event could be the gaming symbols which make the outcome of a roulette play. Still another example of an event could be the first card dealt to the dealer after mixing the cards in a card game. Another example would be the selection of a particular player at a casino game. Another example would be the ranking of a player or a team after a game, after a round, at the end of the tournament, etc.

For the purpose of the present invention, the term "gaming symbol" is intended to mean any symbol used in any casino game. It can be a number, a color, a figure, a suit, etc. It can also be a specific card in a card game. Selections and combinations of gaming symbols can be made to represent all possible events which can occur in a casino game.

BRIEF DESCRIPTION OF THE DRAWINGS

These and other features, aspects and advantages of the present invention will become better understood with regard to the following description and accompanying drawings wherein.

DETAILED DESCRIPTION OF THE PREFERRED EMBODIMENT

While illustrated in the block diagrams as groups of discrete components communicating with each other via distinct data signal connections, it will be understood by those skilled in the art that the preferred embodiments are provided by a combination of hardware and software components, with some components being implemented by a given function or operation of a hardware or software system, and many of the data paths illustrated being implemented by data communication within a computer application or operating system. The structure illustrated is thus provided for efficiency of teaching the present preferred embodiment.

Figure 1:
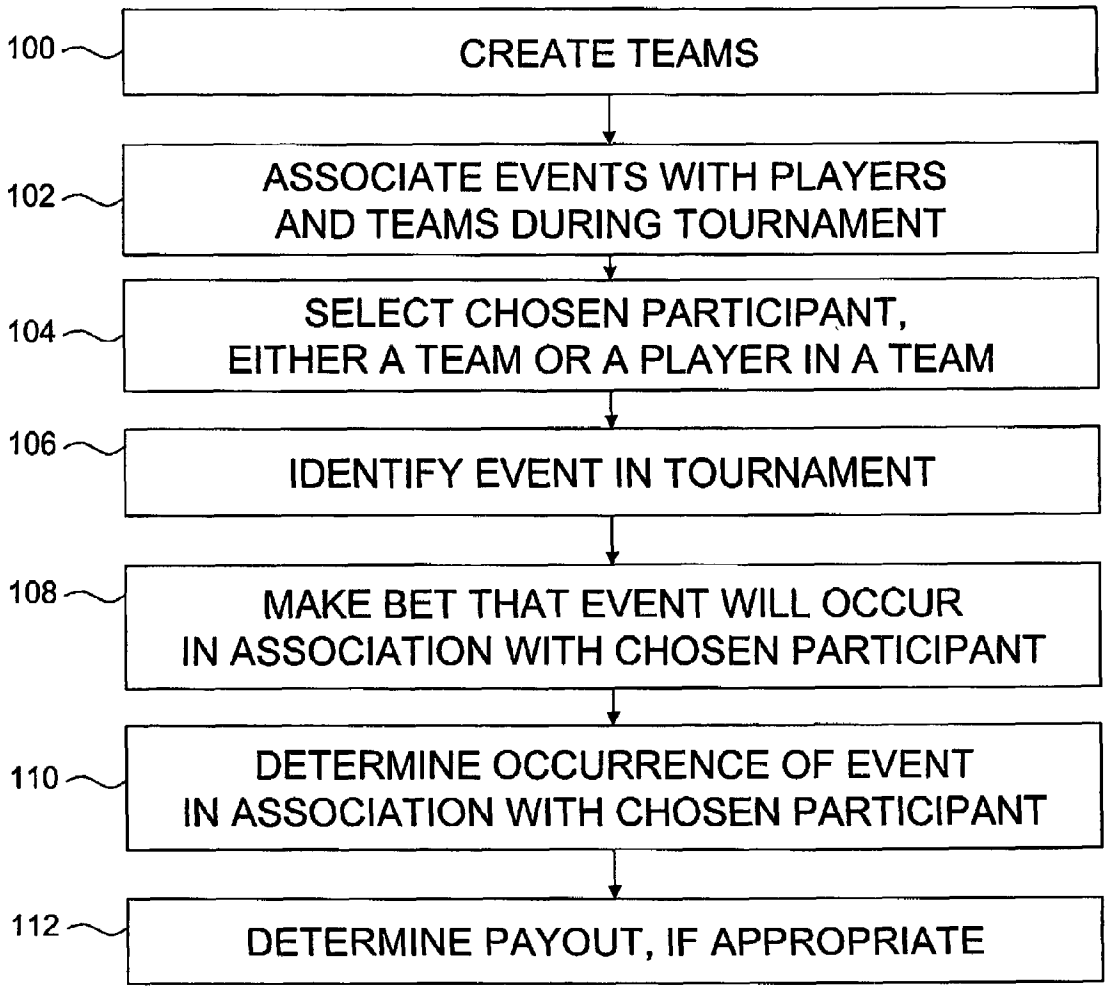
FIG. 1 is a flow chart of the main steps of the preferred embodiment of the present invention.

The method of the present invention will now be described with reference to FIG. 1. A method of betting on participants in a tournament is provided for. The tournament is a tournament of casino games in which the casino can manage the games directly or it can be a tournament of non-bank house games, where players play among themselves and the house only takes a fee for providing the installations (tables, chairs, conference hall, etc.)

The method comprises, at step 100, creating at least two teams each having at least one player playing in the tournament. Two teams are necessary to create a competition, even though each team could only have one player. Two players would then be playing against each other with the remaining organization of the tournament being much simpler. Typically, the games are played in rounds, each round having one or a plurality of instances of a particular casino games, as is known in the art, and players advance to the next round depending on their overall ranking or their ranking at the particular instance of the game. Only the top two players of an instance of the game can advance to the next round or all players except the worst ranked player or bankrupt player will advance, etc. The rules of the particular casino game and of the tournament are assumed to be known by all participants and betting players in the present description. Furthermore, play in the casino game and in the tournament is assumed to be well organized and managed and will not be discussed herein. Participation in the casino game and in the tournament by the participants is not the object of the present invention and therefore the steps of wagering, playing, collecting payouts and recording game results of the casino game being played by the participants in the tournament will not be described in detail.

At step 102, at least one event is associated with the players and teams during the tournament. The event can be that a player has won a particular game, a particular round, or the tournament. The event can also be that a player has reached the second round or that a player was eliminated in the first round. The event can be that all players in a team will advance to the next round. The event can also be that the player is the only one in his team to have reached a particular round. The event can be that the team finished third in the round. Any event concerning a player and/or a team that happens during the tournament is noted. The more events are noted, the better the betting options for the betting players will be. Ideally, each and every move of each and every player and team will be noted to maximize the betting options for the betting player. Alternatively, only certain events can be noted and will then be available for betting, such as the ranking of each player and each team.

Typically, the dealer or a tournament clerk is responsible for the inputs to the game controller. Outcome data input by the dealer, concerning the game, typically include a number of selections of gaming symbols related to the game and a number of indicators identifying a number of players having received some of the selections of gaming symbols, during the play of the game. In some embodiments, the game controller 124 could determine automatically each event received or associated to each player during a play of the game. For example, a card reader or a digital card system could be used which automatically tracks the cards and the sequence in which they are awarded to know exactly what each player has in each hand.

At step 104, a betting player selects at least one participant on which to place a bet. Each participant chosen can be a player or a team. The betting player can be a player participating in the tournament or can be an outsider who simply wishes to bet on a chosen participant. The betting player does not need to be physically present during the game to bet on a participant and may choose his participant remotely, even in advance of the game. The betting player identifies a participant on which to place a bet. Since the team may only have one player, the betting player can be choosing an individual player, even if he is choosing a team.

At step 106, the betting player identifying at least one event related to the tournament for which to place a bet. The event is meaningful within the tournament. Any event which can be recorded at step 102 during the tournament can be chosen by the betting player. It can be an event related to the outcome of a game, a round, or the tournament itself, such as the identity, ranking, performance, etc. of the winner(s) or loser(s). The performance of a participant can be tracked using a point value or a credit value, depending on the rules of the tournament. The event can also be the time required to complete a game, a round, or the tournament itself. The event can be a particular set of gaming symbols which can get attributed to a participant during a game, etc.

At step 108, the betting player makes at least one bet that an event will occur in association with the chosen participant during the tournament. A wager amount, for example an amount of credits or of tokens, can be collected by the casino in order to record the bet. The betting player therefore associates his chosen participant to the chosen event and tries to predict that the chosen event will occur in association with the participant during the tournament. The betting player can make a plurality of such bets, on similar or different events and participants.

The type of bet placed can be of any kind. Examples of types of bets are as follows:

TABLE 1

Examples of types of bets

| Event | Description and Relationship with participant |
|---|---|
| Win | The specific chosen participant will finish first |
| Place | The specific chosen participant will finish first or second |
| Show | The specific chosen participant will finish first, second or third |
| Across The Board | Betting across the board is simply making an equal win, place and show wager on one specific chosen participant. Saying "$2 across the board on number six" is the same as $2 to win, $2 to place and $2 to show on number 6 for a total of $6. |
| Quinella or Reverse Forecast | To win a quinella wager one must pick the 1st and 2nd place finishers in any order. If one plays a 1-2 quinella, and the race finishes 1-2 OR 2-1, he is a winner. |
| Exacta or Perfecta or Straight Forecast | To win an exacta, one must select the chosen participants that finish 1st &2nd on a single ticket. The two chosen participants must finish in the exact order. |
| Straight Trifecta or Triple | To win a trifecta, one must select the chosen participants that finishes 1st, 2nd AND 3rd in the exact order. |
| Standout Trifecta | One must accurately specify the chosen participant that will win, and then select which two chosen participants will come in second and third irrespective of the order. |
| Box Trifecta | One simply needs to specify the three chosen participants that will win, place and show, irrespective of the order. |
| Superfecta | A bet placed on four chosen participants to cross the finish line in the order the betting player specified. |

As will be readily understood, in some embodiments, the player can be allowed to generate a random bet. The random bet can comprise a random selection of participant and/or a random selection of the event. Therefore, a betting player who does not wish to take the time to evaluate the teams and players and/or who does not know the game being played in the tournament sufficiently to identify an appropriate event to bet on may choose to place a random bet where at least a portion of his bet is randomly determined and attributed.

As will also be readily understood, a betting player could simply wish to choose a tournament player and shadow his every move by betting on that player's every hand with a smaller wager. For example, if the tournament player is playing Baccarat with a minimum wager of $2000 per hand, the betting player could place his bets on the same events as the tournament player but with a wager of 0.50 $ per hand. The betting player would pick this tournament player because he believes he will win most of his hands. Similarly, if a betting player believes that a tournament player is particularly weak or unlucky, he could shadow his bets by placing an opposite bet on each hand thereby betting that the tournament player will lose what he himself is betting on.

At step 110, an occurrence of the chosen event in the tournament in association with the chosen participant is determined. If it is determined that the chosen event happened in association with the chosen participant during the tournament, the betting player has won his bet. If the event happened in association with another participant not chosen by the betting player or did not happen at all, the betting player has lost his bet. A payout will typically only be paid if the betting player won his bet. In other embodiments, consolation prizes can be awarded for having chosen a specific event that did occur in the tournament even though it did not occur in association with the chosen participant.

If the bet is won, a payout is calculated at step 112 and can be paid to the betting player. Different means for receiving wagers and paying out payouts exist such as through electronic banks, using casino tokens, through charges and credits on a credit card, etc and will not be discussed further. This payout is clearly independent of that awarded to the participants in the tournament if they win the tournament. If the betting player is a participating player participating in the tournament, and he happens to win the tournament, he will receive the payouts provided for in the tournament in addition to receiving the payout provided for in the present invention.

It is also possible to cumulate multiple bets by the betting player and award special prizes in the event of multiple wins. For example, if a player makes 5 separate and different bets and wins in 3 of the 5 bets, he could be awarded a special cumulative prize for the cumulative win.

Figure 2:
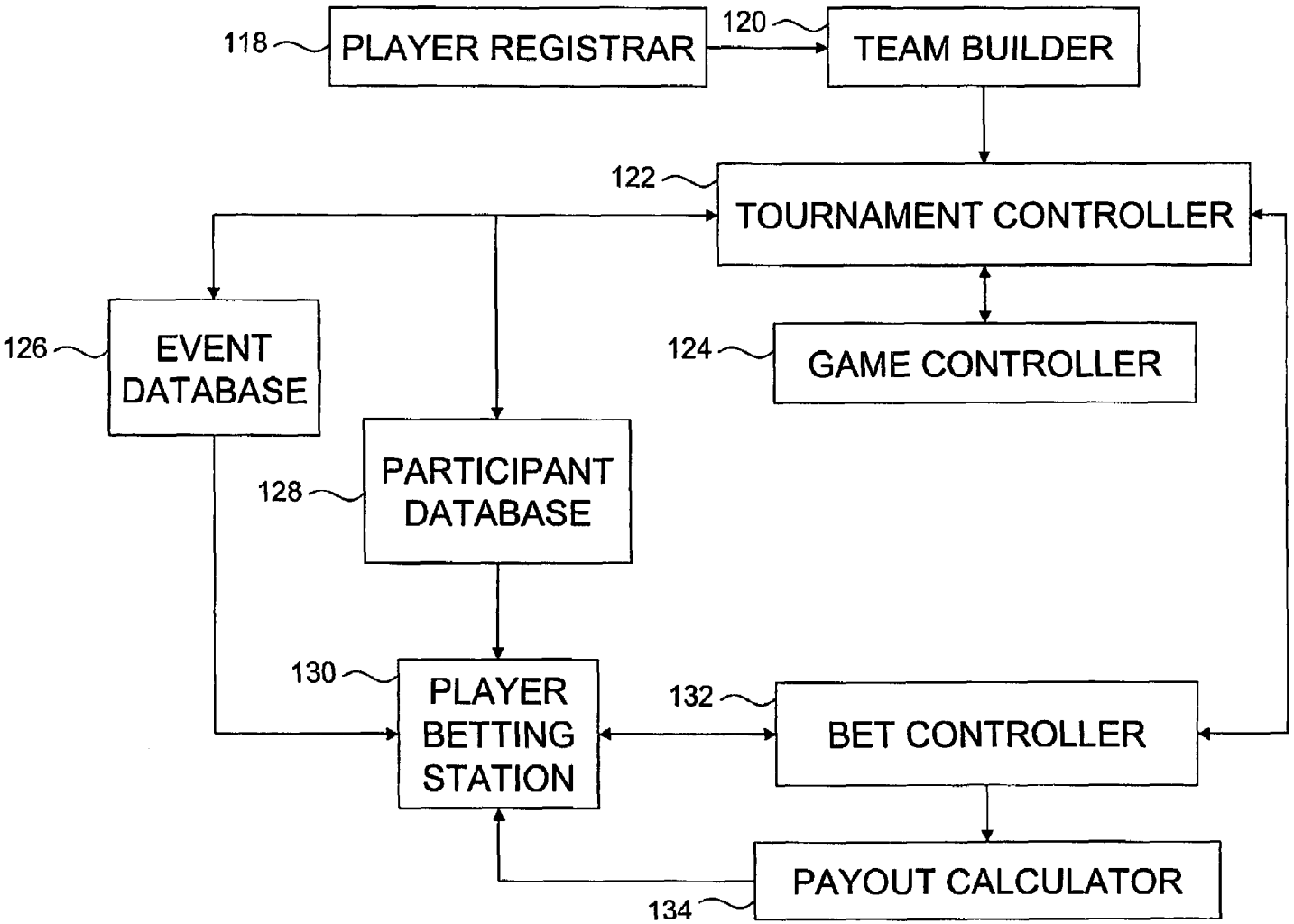
FIG. 2 is a block diagram of the main components of the preferred embodiment of the present invention.

The apparatus of the present invention will now be described with reference to FIG. 2. Each player registers for the tournament at the player registrar 118. The player registrar can be preferably a software tool which allows to register a plurality of data concerning the player. Once information concerning at least one player is stored, a team can be built. Information concerning the player can be limited to his name but can also include a plurality of other pieces of information such as global ranking prior to the tournament, age, number of times he has participated in this tournament or in any tournament, preferred teammates, country, state and city of residence, league, association and division to which he belongs, when and where he qualified to participate in the tournament, etc. The dealer could be registered as a player and be part of a team consisting of only dealers or of players and dealers.

A team builder 120 is used to create teams of at least one player. The teams can be created randomly using the list of players registered for the tournament or teams of players can register as a team for the tournament or be assigned to a specific team depending on a criteria or characteristic. The team builder is preferably a software tool which allows to track exactly which player is a member of which team and which can make the random or planned grouping into teams. Teams can have any number of players as allowed by the rules of the tournament. Teams can be built using any criteria or characteristics. For example, teams can have a geographical characteristic, such as all players of the team belong to a particular city or state. Teams can be built depending on the players' ranking in a player's league or association or in any other way. Teams can comprise players representing a specific organization, company or group. The teams themselves can be grouped into leagues, associations and divisions. Similarly, teams can comprise sub-groups of players with a particular characteristic.

The rules of the games and the tournaments can allow for different types of teams to be built. Building and managing teams is not the object of the present invention but information on the types of teams helps to understand the types of events on which the betting player can bet so more detail on that aspect is given herein.

Indeed, one type of team would be a relay team in which players of the team play sequentially and take the previous player's place and points/ranking at the time of the switch. The relay could be organized based on time, each player playing for a period of two hours, for example, or the relay could be organized based on points, each player being allowed to cumulate a certain number of points and when that point value is reached, the next player of the team takes the place of the previous. The relay could also be organized based on a number of games being played by each player before the player is switched.

Another type of team is a cumulative team in which each player of the team plays for himself, as if he did not belong to a team but points cumulated by each member of the team are added to create a team ranking.

Another type of team is an elimination team where one player is eliminated from the team at each round, the worst player of the team in each round typically being the one who is eliminated, and the winner of the tournament is in fact the winning player among his own team and among all winning players of all teams.

Teams could have a team bank of credit and play until the bank is emptied or each player of the team could have a player bank and get personally eliminated if their bank gets emptied. In some embodiments, the whole team could be eliminated if one player empties his bank.

Another type of team is a random team in which a player from each team is randomly picked or determined to play at specific tables until elimination. When a player of the team is eliminated, another is randomly chosen and plays for the team until a winning player is determined, thereby determining a winning team.

Another type of team is a team of 4 players in which each player is assigned to a table. The teams in which at least two players win at their respective table advance to the next rounds until elimination.

As will be readily understood, other types of teams can be created without departing from the present invention.

The tournament controller 122 is used to manage the whole tournament by storing the identity of the teams, of the players making up the teams, of the outcomes of each game, of each round and of the tournament. It can be used to determine who advances to the next round by processing the results of each game and can also be used to manage the more practical aspects of the tournaments such as who sits at which seat and table in the case of a table casino game or who plays in what order in each team in the case where the tournament is played as a relay by the players of each team. The tournament controller can also keep track of time by storing clock values at the beginning and at the end of each game, etc.

The game controller 124 is used to track everything concerning a particular game and report to the tournament controller. It is a standard game controller as used in the art which manages bets, events, etc for each game. A plurality of such game controllers can be provided and networked to the tournament controller 122.

Before playing a game of the tournament, some parameters must be set in the game controller and in the tournament controller. The parameters concern essentially a selection of game(s), the rules of operation of the game(s), a selection of betting categories and modalities and payout determining and calculating processes. Similarly parameters of that sort should be set in the bet controller.

A player betting station 130 is provided to allow a betting player to place a bet in the tournament. The betting player identifies an event using the event database 126 which is updated by the tournament controller 122 and identifies a participant using the participant database 128 which is also updated by the tournament controller 122. The player betting station allows the betting player to place a bet that the chosen event will occur in association with the chosen participant. In some embodiments, the player betting station can allow a player to generate a random bet. The random bet can comprise a random selection of participant and/or a random selection of the event.

The bets made by the betting player can have different types. Four types of bets are envisioned, namely: a unique, predetermined participant within a team will receive a unique predetermined event; a unique, predetermined participant within a team will receive at least one of a number of determined events; at least one of a number of participants within teams will receive a unique predetermined event; at least one of a number of participants within teams will receive at least one of a number of events. The betting player could decide to bet on a particular player member of a team or on the whole team.

Betting options for the betting player can be modified according to the events recorded in the game and tournament controllers.

Timing of the bets with respect to the tournament can be achieved using the bet controller 132. Betting players may only be allowed to place their bets before the tournament begins. Alternatively, they can be allowed to place bets before each round begins, etc.

Preferably, a wager is taken from the betting player using the player betting station 130. All bets made by betting players through any player betting stations which can be networked are received by a bet controller 132 which manages the bets of the present invention. The bet controller receives indications of occurrences of the events in association with the participants and determines if the betting player won or lost his bet. It then controls a payout calculator 134 to award a prize to the betting player accordingly. The prize could be tangible, such as a car, a trip, etc. or be a cash amount. The payout can be dependent on the tournament participant profile, on the betting player profile or on any other parameter that the manager wishes to introduce.

Networks can ensure communication between the plurality of units of the apparatus. Of course, the network communication could be wired or wireless.

The player betting station 130 can be installed around a casino table if the game played is a table casino game and/or can be installed at a remote location from the table. Typically players in the tournament will prefer that player betting stations 130 be located away from the tables or the game sites. Such a player betting station could be placed at another casino game table, at a bar or besides a slot machine, or in another casino or even, in a hotel room, in an office or inside a private home wherein the player betting station is in communication with the bet controller 132 via a local wired or wireless network or/and via the internet. The bet controller 132 is in communication, for example, with a modem. The modem can be used as a communication means with another casino tournament controller, a hotel server, or with an inter-network server, permitting betting players to bet from their own intranet and/or internet player betting station terminals. Remote betting on a tournament, especially a televised or internet-broadcasted tournament has the advantage that the betting player can be sitting at home watching the tournament and placing his bets via his personal computer and internet. This is extremely convenient for the betting player and extra revenues can be generated for the tournament just by allowing the betting player to get more involved while watching the tournament, which he is already doing.

Players in the tournament could be filmed for broadcasting and marketing purposes. This would allow the betting players to follow the action or view particularly exciting portions of the games. It could also be used for safety reasons and to ensure that there is no cheating. Players could then be compensated for the filming by being awarded a portion of what the betting players betting on them will win. For example, if a betting player bets that a team will reach the last round and the team does reach the last round, the players of that team who accepted to be filmed could receive a percentage of what that betting player won. The tournament players could be compensated in any other way. For example, if a player wins the tournament and $50,000 were bet on him by betting players, he could obtain a percentage of all bets placed on him, for example 1% of the bets, that is $500 as a compensation for having accepted to be bet upon. If the same player loses the tournament, he could still get compensated but by a lesser amount, for example, ¼%, that is $125. The compensation could be calculated based on annual, weekly, daily bets made by betting players on that player. Alternatively, fixed prizes could be awarded to all willing players as a compensation. Also, the player with the most bets by betting players made on himself in a particular tournament, or a year, could get a special prize, such as a car.

Preferably, the player betting station comprises a display in communication with the bet controller to display a plurality of information such as game outcomes, random selection results, jackpot value and prizes, winning combinations and winners, some game information and/or advertising messages.

A plurality of prize amounts can be determined based on bet data stored into the bet controller 132, and game and tournament outcome data stored into the tournament controller 122. According to the game program selected, a number of data are compared and/or accumulated and/or counted in order to identify a prize upon comparison and/or accumulation of a number of data. It is possible to award larger prize in consequence of lower odds of some events, determining betting players to wager more.

Depending on the game program, prize amounts can be determined as a function of the event, as a function of the number of players playing at the play of the underlying game, as a function of the number of players participating to the auxiliary game, as a function of the jackpot fund, as a function of the bet amount. Furthermore, the prize could be a predetermined fixed amount, a randomly selected prize amount from a set of predetermined fixed amounts, a predetermined percentage of the jackpot fund or a randomly selected percentage of the jackpot fund.

In the case where the prize amount is calculated as a function of the bet amount, many payment schemes could be designed. If a player wagers multiples of a unitary bet amount, the corresponding potential amount won is calculated according to the bet amount and the unitary amount won is multiplied accordingly. To make an incentive for the betting players to bet higher bet amounts, an additional percentage and/or amount of credits could be added to the potential amount won, proportionally to the bet amount. For illustration, consider the following payout table:

TABLE 2

Example Payout Table with fixed incentive

| Bet amount wagered | Proportional amount won | Incentive amount (fixed) | Total winning amount |
|---|---|---|---|
| 1 | 30 | 0 | 30 |
| 2 | 60 | 2 | 62 |
| 3 | 90 | 4 | 94 |
| 4 | 120 | 6 | 126 |
| 5 | 150 | 8 | 158 |
| 6 | 180 | 10 | 190 |
| 7 | 210 | 12 | 222 |
| 8 | 240 | 14 | 254 |
| 9 | 270 | 16 | 286 |
| 10 | 300 | 18 | 318 |

Of course, the incentive amount can be calculated using other schemes, for example as a percentage of the number of units bet, or a percentage of the amount won. In the case where the incentive winning amount is a percentage of the winning amount, the corresponding incentive winning amount should be rounded up or down to the nearest credit unit integer. For illustration, consider the following payout table in which an incentive of 20% of the bet amount is used:

TABLE 3

Example Payout Table with proportional incentive

| Bet amount wagered | Proportional amount won | Incentive amount (proportional) | Total winning amount |
|---|---|---|---|
| 1 | 5 | 0 | 5 |
| 2 | 10 | 0 | 10 |
| 3 | 15 | 0 | 15 |
| 4 | 20 | 0 | 20 |
| 5 | 25 | 1 | 26 |
| 6 | 30 | 1 | 31 |
| 7 | 35 | 1 | 36 |
| 8 | 40 | 1 | 41 |
| 9 | 45 | 1 | 46 |
| 10 | 50 | 2 | 52 |

Clearly, in the case of an underlying game where different combinations of gaming symbols affect the proportional amount won by the player, such as Poker for example, the incentive amount won could also be awarded proportionally or using fixed amounts. For illustration, consider the following payout table:

TABLE 4

Example Payout Table with incentive when underlying game is Poker.

| Event | Incentive Amount won | Bet amount wagered | Incentive amount | Total winning amount |
|---|---|---|---|---|
| 4 of a Kind or better | 1000 | 1 | 0 | 1000 |
| | | 2 | 100 | 2100 |
| | | 5 | 500 | 5500 |
| | | 10 | 1000 | 11000 |
| Full House | 500 | 1 | 0 | 500 |
| | | 2 | 100 | 1100 |
| | | 5 | 200 | 2700 |
| | | 10 | 300 | 5300 |
| Flush | 200 | 1 | 0 | 200 |
| | | 2 | 50 | 450 |
| | | 5 | 100 | 1100 |
| | | 10 | 200 | 2200 |
| Straight | 50 | 1 | 0 | 50 |
| | | 2 | 10 | 110 |
| | | 5 | 25 | 275 |
| | | 10 | 50 | 550 |
| 3 of a Kind | 8 | 1 | 0 | 8 |
| | | 2 | 0 | 16 |
| | | 5 | 10 | 50 |
| | | 10 | 20 | 100 |

In another embodiment of the invention, the prize amount can be a cumulative amount.

The player credit payout data—i.e. winning bets and corresponding prize amounts—are communicated from the payout calculator 134 to the player betting station 130 and to potential displays for display.

Prize amounts may be given out manually, as chips or tokens and/or electronically, with or without the help of the player betting station 130, credit amounts may be transferred directly into the credit bank associated to the player.

A further embodiment of the invention could include a "bad beat" scenario. If the betting player decides to bet on any player and the dealer, and either or both of the two have a winning combination but end up losing the hand because of another player's combination, the prize for the betting player can be increased because the betting player bet on the dealer and another player. For example, in the game of blackjack, the prize could be increased if the betting player bet on himself as a participant and the dealer and he happened to lose the hand to the dealer while he had 21 and the dealer had a blackjack.

The prizes for the betting players can be progressive.

A payout scheme for the present invention could be as follows. For each dollar or credit wagered by a betting player, a predetermined percentage is set aside to be awarded in prizes. For example, 70% of the wagers could be given out in prizes, the manager of the game keeping a 30% portion for overhead fees, profit and in some embodiments sharing with the winning or losing participants of the tournament as an incentive to accept to be bet upon by betting players.

Therefore, continuing with the 70% example, if one million dollars is wagered by betting players, $700,000 will be awarded in prizes depending on the bets made by the betting players.

In one embodiment, 10% of the $700,000 can be awarded to the betting players who correctly identified the winner, in the case where the event that can be bet upon by the betting players is simply the outcome of a round or of the tournament, namely who will finish first. A bigger portion of that 10% will be awarded to those who placed their bet early on in the tournament since it was more difficult to determine an ultimate winner among all participants by comparison with a betting player who bet just before the last round, when a good portion of the participants are already eliminated. The 10% will be divided among all betting players who correctly identified the winning participant.

In the case where the events bet upon by the betting players are the ranking of the winners of a round or of a tournament and the event specifies the first 5 top ranked participants at the end of the round or tournament, the bet being a bet in which the order is important or not, the payout scheme could be as follows:

TABLE 5

Payout Scheme for Rank betting

| Betting Player Prizes | Percentage of amount to be awarded | Degree of match of bet if order matters | Degree of match of bet if order does not matter | Percentage of amount to be awarded |
|---|---|---|---|---|
| First Prize | 15% | 5 out of 5 | 5 out of 5 | 5% |
| Second Prize | 10% | 4 out of 5 | 4 out of 5 | 4% |
| Third Prize | 10% | 3 out of 5 | 3 out of 5 | 3% |
| Fourth Prize | 10% | 2 out of 5 | 2 out of 5 | 2% |
| Fifth Prize | 10% | 1 out of 5 | 1 out of 5 | 1% |

Therefore, a practical example of the above payout scheme would be the following: 3 betting players qualify for first place, 100 betting players qualify for second place and 20 000 betting players qualify for third place. We will ignore fourth and fifth place for this example. There is a total amount in prizes to be awarded of $500,000. Therefore, the three betting players who won first place will each receive $25,000 (15 % of $500,000 divided by 3 winners), the 100 betting players who won second place will each receive $500. Finally, the 20,000 betting players who finished in third place will each receive $2.50.

It will be understood that numerous modifications thereto will appear to those skilled in the art. Accordingly, the above description and accompanying drawings should be taken as illustrative of the invention and not in a limiting sense. It will further be understood that it is intended to cover any variations, uses, or adaptations of the invention following, in general, the principles of the invention and including such departures from the present disclosure as come within known or customary practice within the art to which the invention pertains and as may be applied to the essential features herein before set forth, and as follows in the scope of the appended claims.

What is claimed is:

1. A method of betting on participants in a tournament, the method comprising:

providing an identification of at least two participating players participating in a tournament including an indication of a tournament team to which each said participating players belong, at least two of said tournament teams participating in said tournament, said tournament having a series of casino games in which said participating players will play;

carrying out said series of casino games according to rules of play of said casino games, including associating at least one event with at least one participating player during said tournament;

a betting player creating a selection team by selecting at least two chosen participants on which to place a bet, each said chosen participant being one of said participating players belonging to one of said tournament teams, said selection team comprising chosen participants from at least two non-identical tournament teams;

said betting player identifying at least one event related to said tournament for which to place said bet, wherein said event is meaningful within said tournament;

said betting player making at least one bet that said at least one event will occur in association with said selection team during said tournament;

determining an occurrence of said at least one event in said tournament in association with said at least one chosen participant of said selection team; and if said at least one event occurred in association with said selection team, determining a payout to be paid to said betting player;

wherein said betting player is one of said participating player and a player who does not participate in the tournament.

2. The method as claimed in claim 1, wherein said at least one event is receiving at least one predetermined gaming symbol.

3. The method as claimed in claim 1, wherein said at least one event is becoming a winner of a round of the tournament.

4. The method as claimed in claim 1, wherein said at least one event is being ranked third at a conclusion of the tournament.

5. The method as claimed in claim 1, wherein said participating player is a dealer of said casino game.

6. The method as claimed in claim 1, wherein the casino game is a card game.

* * * * *